United States Patent [19]

Russell

[11] 4,015,850

[45] Apr. 5, 1977

[54] BINGO DICE GAME

[76] Inventor: Mitchell John Russell, 814 N. Delaware, San Mateo, Calif. 94010

[22] Filed: Sept. 2, 1975

[21] Appl. No.: 609,247

[52] U.S. Cl. ..... 273/135 B; 273/135 AA; 273/146

[51] Int. Cl.[2] ..... A63F 3/06

[58] Field of Search .... 273/135 AA, 135 B, 134 D, 273/146

[56] References Cited

UNITED STATES PATENTS

| | | | |
|---|---|---|---|
| 1,238,522 | 8/1917 | Kalista | 273/135 B |
| 1,655,380 | 1/1928 | Parker | 273/135 B |
| 2,070,608 | 2/1937 | Mitchell | 273/146 |
| 3,549,150 | 12/1970 | Weeks | 273/135 B |

OTHER PUBLICATIONS

"Las Vegas Bingo Game"; *Playthings* Magazine, July, 1959 p. 99.

"Bingomatic"; *U.S. Purchasing Exchange* catalog, Sept. 13, 1973.

*Primary Examiner*—William H. Grieb

*Attorney, Agent, or Firm*—Flehr, Hohbach, Test, Albritton & Herbert

[57] ABSTRACT

A game for two or more players wherein each player is provided a card having rows and columns of spaces in a matrix formation. A number is placed in the space at the intersertion of each row and column. The columns are five in number having the letters, B, I, N, G and O respectively at the head of each of the five columns. A pair of dice having six faces each are provided. The six faces of one dice carry indicia B1, I2, N3, G4, O5 and DICE respectively. The six faces of the second dice carry the numerals 2 through 7 respectively. The combination of indicia on the upturned faces of the two dice after being cast, provide an indication corresponding to certain of the numbers in ones of the spaces on the various playing cards. When the combination number appears on a players card, he is entitled to place one of a plurality of markers provided for the purpose on the space in the matrix containing the number. The players have as an object to obtain a predetermined pattern on the face of their playing card in as few a number of dice casts as possible. A record sheet is provided to record each of the combinations appearing on the upturned dice faces during the game.

8 Claims, 5 Drawing Figures

BINGO DICE GAME

BACKGROUND OF THE INVENTION

This invention relates to a game for providing entertainment, and more particularly to a game of chance involving two or more players in which the winning player is the first to obtain a predetermined pattern of the face of a playing board in the fewest number of chances.

The game "Bingo" is widely known, and is played by a number of players each having playing cards before them with a matrix of numbers arranged in five rows and five columns. The five columns are headed by the letters B, I, N, G and O in succession from left to right. An operator for the game draws tickets or beads randomly from a mixed mass of the same, each having a letter and a number thereon corresponding to numbers in the matrix on the surface of the playing card. Generally a tub or basket is necessary for holding the tickets or beads which must have some considerable volume to hold one each of very possible number on all of the playing cards issued. Moreover, the large number of tickets or beads in the tub or basket are susceptible to being lost, in which case they must be replaced or else some of the issued playing cards will have numbers without corresponding beads and will be prevented from ever obtaining a winning combination.

A game for providing entertainment is envisioned in which all possible combinations on differently marked playing cards are possible from combinations appearing on the upturned faces of a single pair of dice.

SUMMARY AND OBJECTS OF THE INVENTION

A game is disclosed which includes a plurality of playing cards having playing surfaces on which are indicated a plurality of areas in a matrix configuration, each of which has located therein a symbol which is specific thereto. Different ones of the plurality of playing cards have combinations of symbols in the matrix which differ from card to card. A pair of dice having indicia on each of the dice faces are provided. When the dice are cast and the upturned faces on the dice are observed, the combination of the indicia from the two dice faces corresponds to one of the symbols appearing in one of the areas on some of the playing cards. Each player has a playing card and a plurality of markers for placing on the areas carrying the symbols appearing in successive casts on the upturned dice faces. The first player to obtain a predetermined pattern of markers on the face of his playing card after the dice are cast a number of times, is the winning player.

It is an object of the present invention to provide an entertaining game for a number of players.

Another object of the present invention is to provide an entertaining game in which the number of pieces of equipment is minimized.

Another object of the present invention is to provide an entertaining game in which chance determines the winner.

Additional objects and features of the invention will appear from the following description in which the preferred embodiment has been set forth in detail in conjunction with the accompanying drawings.

DESCRIPTION OF THE PREFERRED EMBODIMENT

Figure 1:
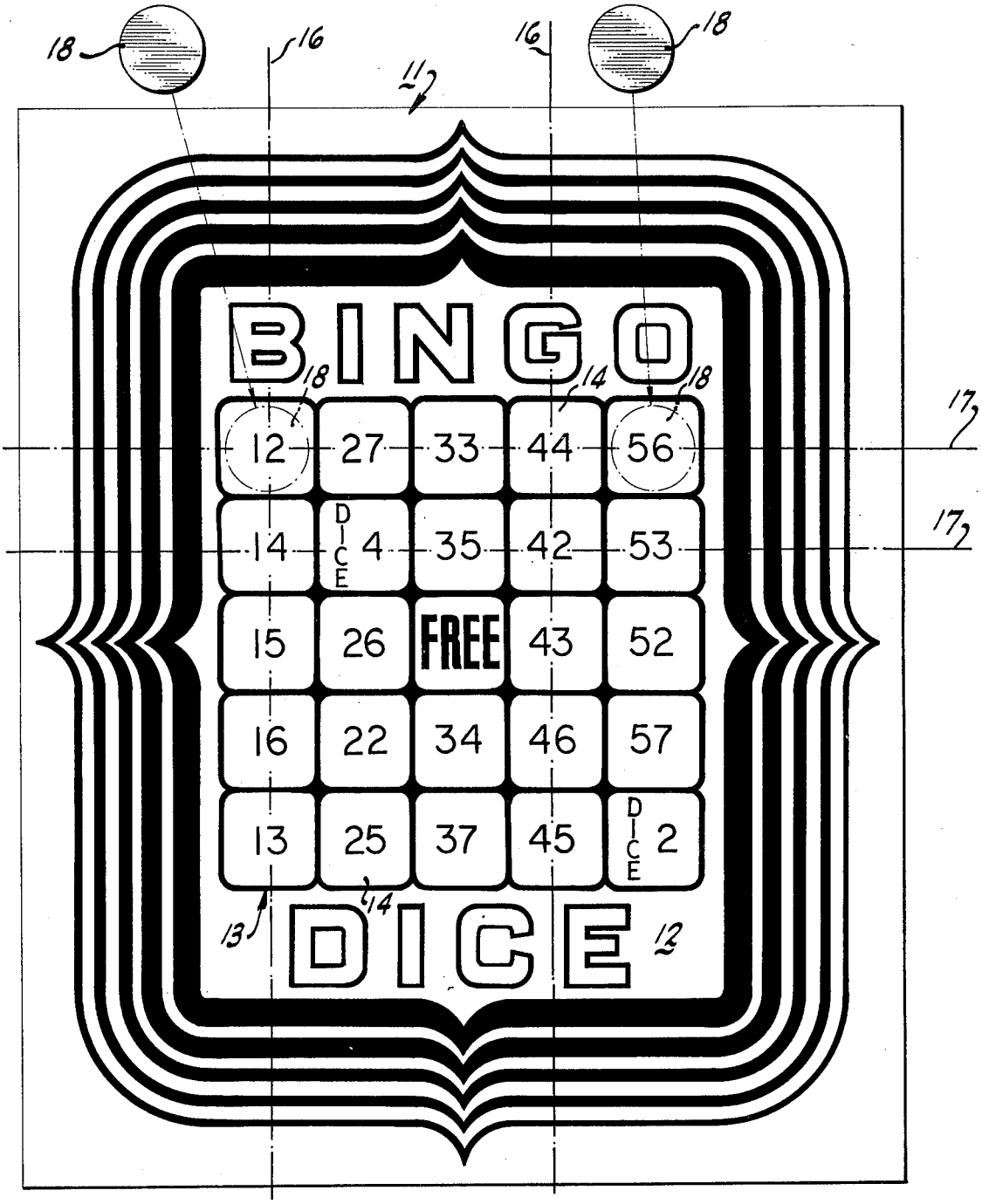
FIG. 1 is a view of the playing surfaces of one playing card.

As shown in FIG. 1 a playing card 11 has a playing surface 12 thereon. Playing surface 12 has a matrix 13 of areas 14 arranged in vertical columns 16 and horizontal rows 17. There are five vertical columns 16 headed respectively from left to right by the letters B, I, N, G and O. A centrally located area is indicated as FREE. Other areas 14 have indicia or symbols such as DICE 4, seen in row 2, column 2 and DICE 2, seen in row 5, column 5, counting from the top row and the left column.

a plurality of markers 18 are provided. Markers 18 have a size such that they fit within areas 14 as indicated in FIG. 1.

Figure 2:
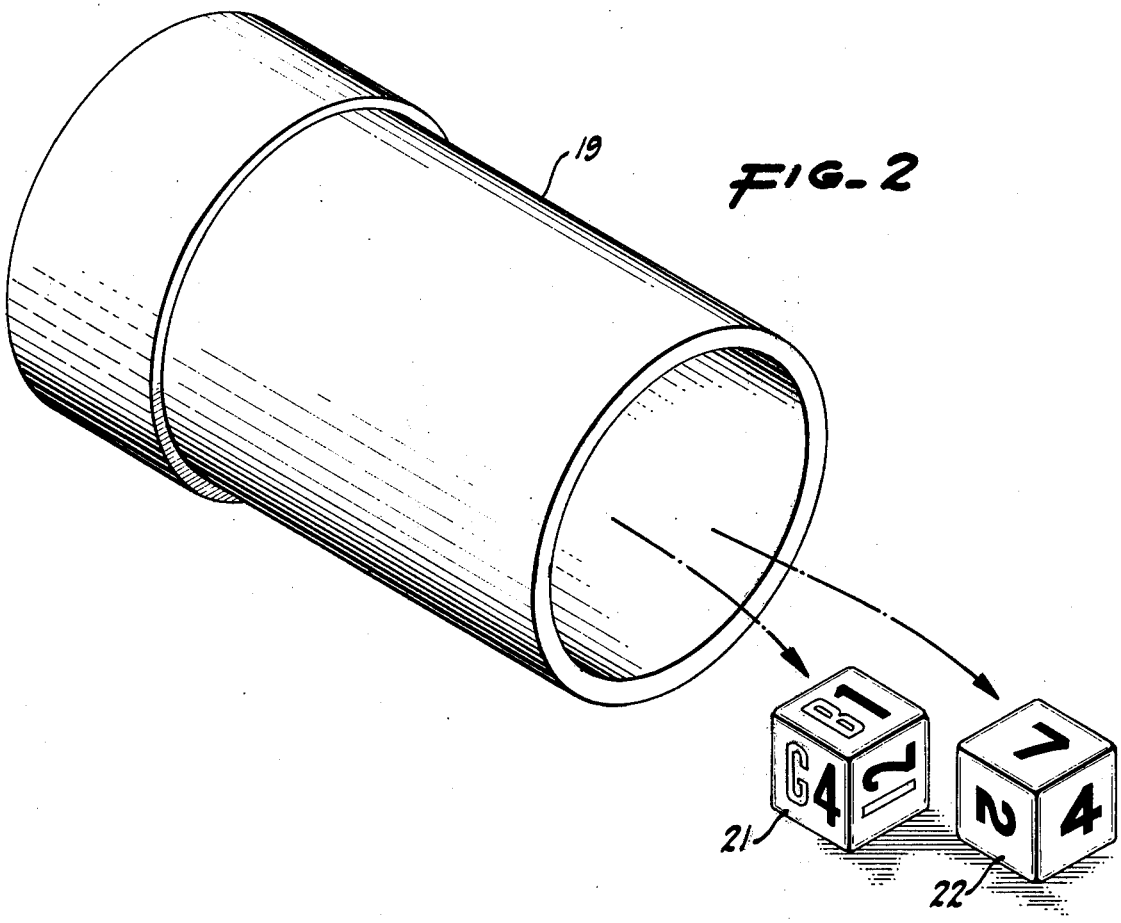
FIG. 2 is an isometric view showing the casting of the dice used in the present invention.

FIG. 2 shows a dice casting cup 19 for shaking a pair of dice 21 and 22, so that when they are cast from the cup 19 they may come to rest in random fashion on a flat surface, and will display an upturned dice face on each of the dice 21 and 22.

Figure 3:
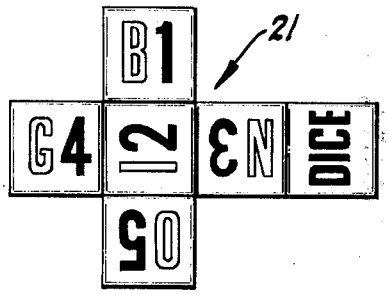
FIG. 3 is a plan view of the six faces of one of the dice in the present invention.
Figure 4:
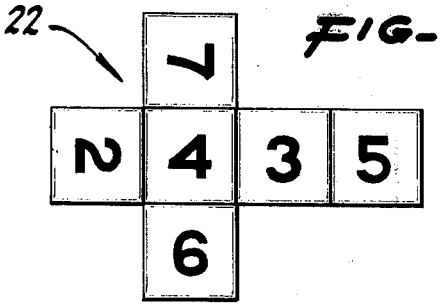
FIG. 4 is a plan view of the other dice used in the present invention.

FIG. 3 shows a layout of the six faces on dice 21 having indicia B1, I2, N3, G4, O5 and DICE. FIG. 4 shows a layout of dice 22 having the numerals 2 through 7 on separate ones of the six faces thereof. It may be seen that the indicia on the two upturned faces of the cast dice 21 and 22, when combined corresponds to the indicia in the areas 14 on the playing surface 12 of some of the playing cards 11. For example, the combination B17 is displayed in FIG. 2.

The manner in which the game of Bingo Dice is played will not be described. Bingo Dice is a game for from two to twelve players. Twelve playing cards 11 are therefore provided having five columns 16 and five rows 17 on the playing surface 12 of each card 11. The object of the game is to cover five numerals in either a horizontal, vertical, or diagonal line prior to the same accomplishment by any of the other players. The center spot is free and may or may not be used depending on the orientation of the winning line.

Figure 5:
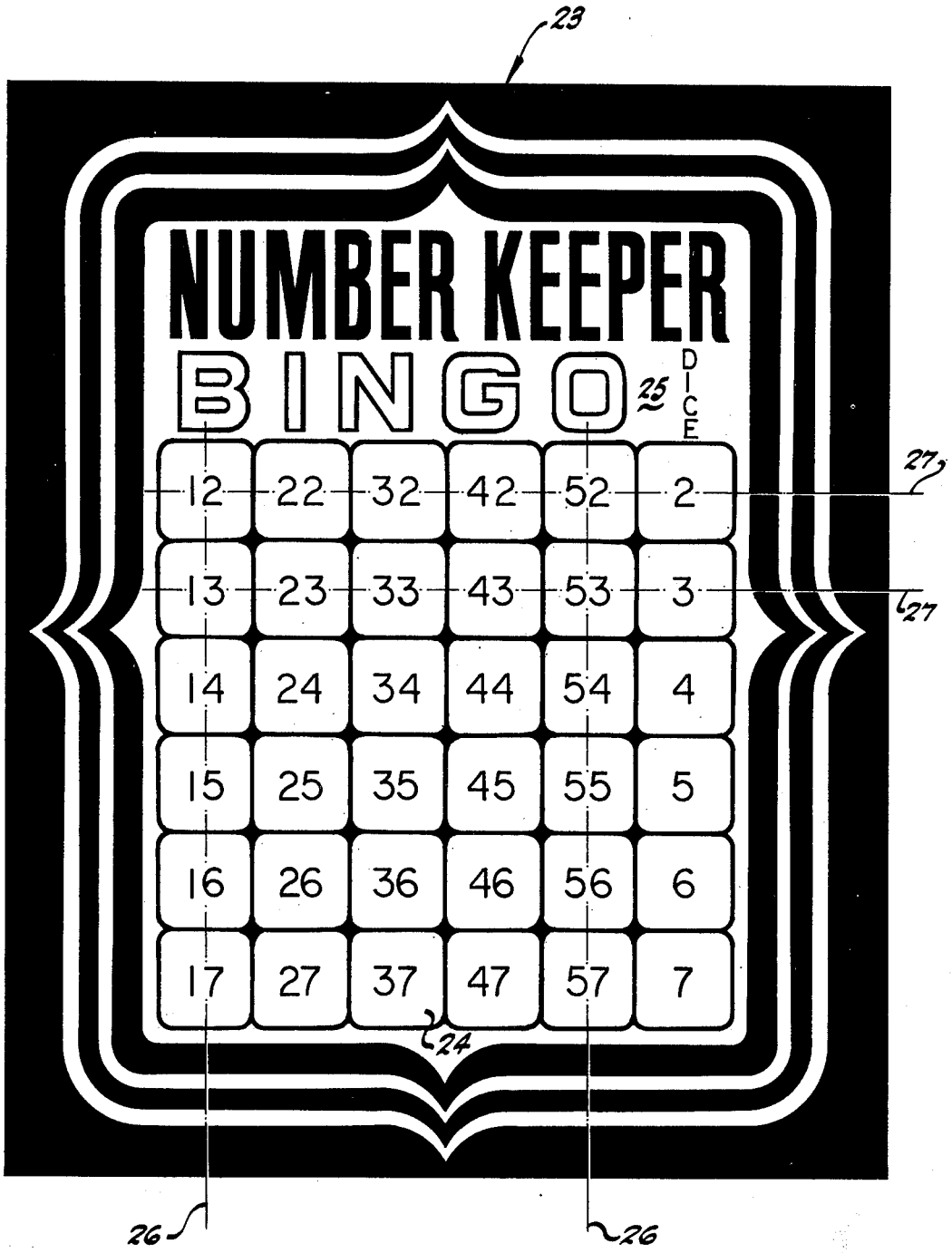
FIG. 5 is a view of a number keeper card.

A master card or number keeper 23 is provided, as seen in FIG. 5, having a record surface 25 upon which each combination of indicia from upturned dice faces on dice 21 and 22 is recorded as the combinations are sucessively cast. A number corresponding to possible numbers which may appear on the combined upturned dice faces is placed in one of a plurality of record areas 24 outlined on the record surface 25 of number keeper 23. By placing a marker 18 over the record area 24 corresponding to the number in each cast combination the number keeper 23 is used to record all numbers that have been cast during each game. One player is designated as the person responsible to record each cast combination. The number keeper 23 is used at the end of the game to verify a winner. The number keeper 23 is a card having six columns 26 and six rows 27 of records areas 24 to cover each of the 36 possible combinations of upturned dice face on dice 21 and 22. These combinations may be seen to be, in this embodiment, column B, numbers 12 through 17; column I, numbers 22 through 27; column N, numbers 32 through 37; column G, numbers 42 through 47; column O, numbers 52 through 57; and DICE numbers 2 through 7.

To begin the game each player rolls dice 22 once. The player rolling the highest number on dice 22 becomes the starter. In the event of a tie, players in the tie cast dice 22 again until the highest number is determined. It is the responsibility of the starter to mark the number keeper throughout the game.

The game begins with the starter and passes unidirectionally from player to player. The starter rolls both dice. The combination of indicia on the upturned faces of dice 21 and 22 is called out to all of the players. For example, in FIG. 2 the combination of indicia is B17. The starter marks B17 in the appropriate record area 24 on the number keeper 23. Any players having the number B17 on their playing cards 11 cover it with a marker 18. The manner in which markers 18 overlie areas 14 is indicated in dashed line in FIG. 1.

The starter then passes the dice to an adjacent player. The adjacent player casts the dice 21 and 22 from dice cup 19 and announces the combination of indicia on the upturned faces of dice 21 and 22. Each player having the announced combination in an area 14 on playing surface 12 of his card 11, covers the area 14 with a marker 18 as before. The starter makes the announced combination on the number keeper 23 as above.

The game continues, passing the dice to an adjacent player, with each player casting the dice in turn until one player completes a horizontal, vertical or diagonal line of five numbers and calls out "Bingo Dice". If a player rolls a previously cast combination on the upturned faces of dice 21 and 22, he must pass the dice, and is not permitted a second roll. Subsequent to an announcement by a tentative winner, the alleged winning line of numbers is checked by the starter by reference to the number keeper 23.

Variations of the above manner of playing Bingo Dice may be incorporated. For example, a winner may be determined by a blackout or covering of all numbers on the playing surface 12 of a players card 11. Another variation is the requirement of obtaining a frame or covering of all number combinations on the perimeter of the playing surface 12 of the card 11. Yet another combination is four corners or the marking of the four numbers at the corners of the matrix 13 on the playing surface 12. Yet another variation is the formation of an X or the marking of all numbers along both diagonals of the matrix 13 on playing surface 12.

A game for providing entertainment for a number of players has been disclosed which utilizes only a pair of dice for determining any one of thirty-six number combinations.

What is claimed is:

1. A game comprising a plurality of playing cards having playing surfaces, indicia on said playing surfaces deliniating a plurality of areas arranged in five vertical columns and five horizontal rows, each of said plurality of areas having located therein a symbol specific thereto, first and second dice each having a plurality of die faces, indicia on ones of said first die faces, including a letter and a number, indicia on ones of said second die faces including different numbers, so that the combination of said dice face indicia from one face of each die corresponds to said symbol specific to one of said plurality of areas on ones of said plurality of playing cards, and a plurality of markers each formed to lie within one of said plurality of areas, whereby successive casting of said pair of dice produces a succession of upturned dice face indicia combinations, so that when said succession of combinations is marked by placing ones of said plurality of markers to overlie corresponding symbols in ones of said plurality of areas, a pattern is created on said playing surfaces wherein the purpose is to duplicate by chance a predetermined pattern on one of said playing surfaces.

2. A game as in claim 1 together with vertical column indicia on said playing surfaces including said letter specific to each of said vertical columns, whereby fast location of said symbol specific to one of said plurality of areas is obtained.

3. A game as in claim 1 together with a master card having a record surface, indicia on said record surface deliniating a plurality of record areas each of a size for accommodating one of said markers, each of said record areas having one of said symbols specific to ones of said plurality of areas on said playing surfaces, all of said symbols being present on said record surface, so that said succession of upturned dice face indicia combinations is recorded thereon by placing one of said markers to overlie a corresponding symbol in ones of said plurality of record areas.

4. A game comprising a plurality of playing cards having playing surfaces, indicia on said playing surfaces deliniating a plurality of areas arranged in vertical columns and horizontal rows, each of said plurality of area having located therein a symbol specific thereto, a pair of dice having a plurality of dice faces, dice face indicia on each of said dice faces, so that the combination of said dice face indicia from one face of each die corresponds to said symbol specific to one of said plurality of areas on ones of said plurality of playing cards, said die face indicia on a first one of said pair of dice including numerals 2 through 7, said die face indicia on a second one of said pair of dice including B1, I2, N3, G4, and O5, said vertical columns being five in number, together with letters B, I, N, G and O for designating said five vertical columns, so that when ones of the formentioned dice face indicia are upturned on said first and second ones in said pair of dice the combined upturned dice face indicia contain a letter indicative of one of said vertical columns and a two digit number indicative of one of said symbols in said one vertical column and a plurality of markers each formed to lie within one of said plurality of areas, whereby successive casting of said pair of dice produces a succession of upturned dice face indicia, so that when said succession of indicia is marked by placing ones of said plurality of markers to overlie corresponding symbols in ones of said plurality of areas, a pattern is created on said playing surfaces for the purpose of duplicating a predetermined pattern on one of said playing surfaces.

5. A game as in claim 4 wherein said die face indicia on one face of said second one of said pair of dice includes an additional symbol so that some combinations of upturned dice face indicia contain said additional symbol and a single digit number.

6. A game comprising a plurality of playing cards having playing surfaces, a plurality of areas deliniated on said playing surfaces arranged in a matrix of columns and rows, distinct column symbols for each of said columns located on said playing surfaces, distinct area symbols located within each of said plurality of areas, said area symbols having random arrangement in each of said columns, first and second dice each having six die faces, indicia on five of said six die faces on said first die including one of said distinct column symbols and portions of one of said distinct area symbols, indicia on the last of said six die faces on said first die providing a portion of one of said distinct area symbols having random arrangement in any of said rows, indicia on ones of said six die faces on said second die including additional portions of one of said distinct area symbols, whereby the combination of indicia from one face of each of said first and second dice corresponds to one of said plurality of areas on ones of said plurality of playing cards, and a plurality of markers for placing within ones of said plurality of areas, whereby successive casting of said first and second dice provides indication of ones of said plurality of areas, and placement of one of said markers on each of said areas so indicated creates a pattern of markers on said playing surfaces.

7. A game as in claim 6 together with a master card having a record surface, a plurality of record areas on said record surface, inidica located in each of said record areas corresponding to separate combinations of indicia from one face of each of said first and second dice, so that combinations of dice face indicia successively cast are recorded by placing one of said markers on one of said plurality of record areas corresponding to each cast combination.

8. A game as in claim 6 wherein said matrix has five columns and five rows, said indicia on said five faces on said first die including different letters and digits, said indicia on the last of said six die faces on said first die including the word "dice", said indicia on said six faces on said second die including different digits, so that some combinations of indicia from one face of each die include a letter and two digit number and other include the word "dice" and a number, said distinct column symbols being ones of said different letters, and said distinct area symbols including ones of said two digit numbers.

* * * * *